US010237665B2

(12) United States Patent
Karamuk et al.

(10) Patent No.: US 10,237,665 B2
(45) Date of Patent: Mar. 19, 2019

(54) CANAL HEARING DEVICES WITH IMPROVED SEALS

(71) Applicant: Sonova AG, Stäfa (CH)

(72) Inventors: Erdal Karamuk, Männedorf (CH); Petra Gunde, Zürich (CH); Simone Keller, Männedorf (CH); Chuangang Lin, Fremont, CA (US); Paul Wagner, San Carlos, CA (US); Michael Au, Union City, CA (US)

(73) Assignee: Sonova AG, Staefa (CH)

( * ) Notice: Subject to any disclaimer, the term of this patent is extended or adjusted under 35 U.S.C. 154(b) by 0 days.

(21) Appl. No.: 15/554,656

(22) PCT Filed: Mar. 9, 2015

(86) PCT No.: PCT/US2015/019519
§ 371 (c)(1),
(2) Date: Aug. 30, 2017

(87) PCT Pub. No.: WO2016/144319
PCT Pub. Date: Sep. 15, 2016

(65) Prior Publication Data
US 2018/0041852 A1 Feb. 8, 2018

(51) Int. Cl.
*H04R 25/00* (2006.01)

(52) U.S. Cl.
CPC ..... *H04R 25/652* (2013.01); *H04R 25/602* (2013.01); *H04R 25/604* (2013.01); *H04R 25/658* (2013.01); *H04R 2225/023* (2013.01)

(58) Field of Classification Search
CPC .. H04R 25/602; H04R 25/652; H04R 25/658; H04R 2225/023
USPC ..... 381/323, 380, 370, 381
See application file for complete search history.

(56) References Cited

U.S. PATENT DOCUMENTS

2006/0291682 A1* 12/2006 Urso ..... H04R 25/652 381/328
2006/0291683 A1* 12/2006 Urso ..... H04R 25/654 381/328
2007/0121980 A1 5/2007 Menzl
2008/0144871 A1 6/2008 Purcell et al.
2009/0320859 A1* 12/2009 Purcell ..... A61F 11/10 128/864
2013/0130097 A1* 5/2013 Wenzel ..... H01M 12/06 429/176

FOREIGN PATENT DOCUMENTS

EP 2384021 B1 * 7/2015 ..... H04R 1/1016
WO WO 00/42817 7/2000
WO WO 2014040649 A1 * 3/2014 ..... H04R 25/652

OTHER PUBLICATIONS

PCT Search Report and Written Opinion dated Sep. 23, 2015 for PCT App. Ser. No. PCT/US2015/019519.

* cited by examiner

*Primary Examiner* — Curtis A Kuntz
*Assistant Examiner* — Julie X Dang
(74) *Attorney, Agent, or Firm* — Henricks Slavin LLP

(57) ABSTRACT

Hearing devices, configured to fit within the ear canal, that include a hearing device core, a seal, including a shell wall and a cavity that has an opening located at the end of the shell wall, and a volume of viscous medium located within the cavity between the hearing device core exterior surface and the shell wall interior surface.

12 Claims, 3 Drawing Sheets

CANAL HEARING DEVICES WITH IMPROVED SEALS

CROSS-REFERENCE TO RELATED APPLICATIONS

This application is the U.S. National Stage of PCT App. Ser. No. PCT/US2015/019519, filed Mar. 9, 2015.

BACKGROUND

1. Field

The present inventions relate generally to hearing devices and, for example, hearing devices that are worn entirely in the ear canal for extended periods without daily insertion and removal.

2. Description of the Related Art

Referring to the coronal view illustrated in FIG. 1, the adult ear canal 10 extends from the canal aperture 12 to the tympanic membrane (or "eardrum") 14, and includes a lateral cartilaginous region 16 and a bony region 18 which are separated by the bony-cartilaginous junction 20. Debris 22 and hair 24 in the ear canal are primarily present in the cartilaginous region 16. The concha cavity 26 and auricle 28 are located lateral of the ear canal 10, and the junction between the concha cavity 26 and cartilaginous region 16 of the ear canal at the aperture 12 is also defined by a characteristic bend 30, which is known as the first bend of the ear canal.

Extended wear hearing devices are configured to be worn continuously, from several weeks to several months, inside the ear canal. Some extended wear hearing devices are configured to rest entirely within the bony region and, in some instances, within 4 mm of the tympanic membrane. Examples of extended wear hearing devices are disclosed in U.S. Patent Pub. No. 2009/0074220, U.S. Pat. No. 7,664,282 and U.S. Pat. No. 8,682,016, each of which is incorporated herein by reference. Such hearing devices frequently include one or more seal retainers (or "seals") that suspend and retain the hearing device within the ear canal and also suppress sound transmission and feedback which can occur when there is acoustic leakage between the receiver and microphone. The seals are frequently formed from a highly porous and highly compliant foam material (e.g., hydrophilic polyurethane foam), which conforms to the ear canal geometry by deflection and compression, using a net-shape molding process. The seals tend to be very small, with outer diameters of around 0.5 inch, and very thin, with wall thicknesses of around 0.02 to 0.03 inch.

The present inventors have determined that hearing devices which are configured to be placed deep in the ear canal are susceptible to improvement. For example, there are a variety of important, and sometimes conflicting, functional goals associated with the seals. Although the friction between the seals and the ear canal must be sufficient to prevent lateral migration of the hearing device, the seals must be compliant enough to conform to the ear canal, and the local pressure exerted on the ear canal wall should be less than the venous capillary return pressure of the epithelial tissue layer of the canal wall (i.e., less than about 12 mmHg). The seals must be durable in that there is no more than minimal degradation or change of structural integrity in response to prolonged contact with sweat, ear wax and soapy water. The seals should also be skin biocompatible. Acoustically, the seals should provide acoustic attenuation in order to prevent feedback (e.g., >40 dB between 200 Hz and 6 kHz). The seals should permit venting that allows pressure equalization between the ambient environment and the closed volume near the tympanic membrane, and have a vapor transmission rate sufficient to prevent moisture accumulation in the closed volume (e.g., MVTR>0.05 mg/h/mm$^2$ at 37° C.). The present inventors have further determined that, given their very thin wall thicknesses, it is difficult to reliably manufacture seals that achieve these goals using net-shape molding and other currently available manufacturing techniques for manufacturing foam objects. In particular, reliably achieving good acoustic attenuation often occurs at the expense of compliance and comfort.

SUMMARY

A hearing device in accordance with at least one of the present inventions includes a hearing device core defining an exterior surface and a seal, including a shell wall, mounted on the hearing device core with the first end of the shell wall secured to the hearing device core and the second end located in spaced relation to the hearing device core. A cavity, which has an opening located at the shell wall second end, is defined between the hearing device core exterior surface and the shell wall interior surface. A volume of viscous medium may be located within the cavity between the hearing device core exterior surface and the shell wall interior surface.

There are a variety of advantages associated with such a hearing device. By way of example, but not limitation, the viscous medium augments the sound attenuation associated with the seal and promotes vapor transmission without substantially increasing the pressure on the ear canal wall associated with the seal or interfering with pressure equalization.

The above described and many other features of the present inventions will become apparent as the inventions become better understood by reference to the following detailed description when considered in conjunction with the accompanying drawings.

BRIEF DESCRIPTION OF THE DRAWINGS

Detailed descriptions of the exemplary embodiments will be made with reference to the accompanying drawings.

DETAILED DESCRIPTION OF EXEMPLARY EMBODIMENTS

Figure 1:
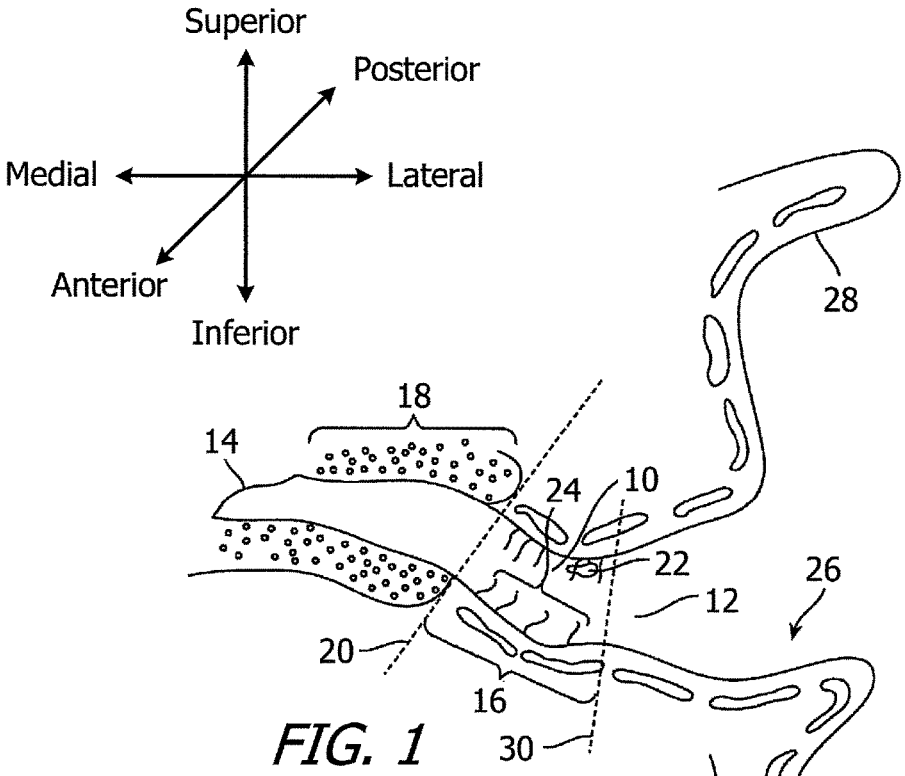
FIG. 1 is a section view showing the anatomical features of the ear and ear canal.

The following is a detailed description of the best presently known modes of carrying out the inventions. This description is not to be taken in a limiting sense, but is made merely for the purpose of illustrating the general principles of the inventions. Referring to FIG. 1, it should also be noted that as used herein, the term "lateral" refers to the direction and parts of hearing devices which face away from the tympanic membrane, the term "medial" refers to the direction and parts of hearing devices which face toward the tympanic membrane, the term "superior" refers to the direction and parts of hearing devices which face the top of the head, the term "inferior" refers to the direction and parts of hearing devices which face the feet, the term "anterior" refers to the direction and parts of hearing devices which face the front of the body, and the "posterior" refers to the direction and parts of hearing devices which face the rear of the body.

Figure 2:
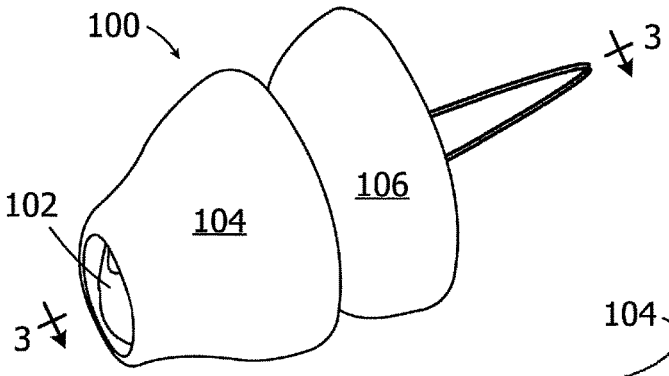
FIG. 2 is a perspective view of an exemplary hearing device.
Figure 3:
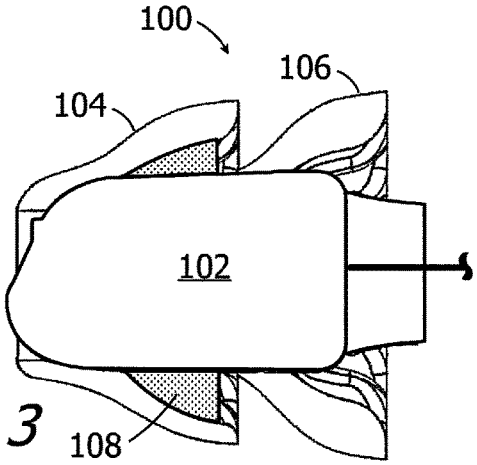
FIG. 3 is a partial section view taken along line 3-3 in FIG. 2.

As illustrated in FIGS. 2 and 3, an exemplary hearing device 100 includes a core 102, a medial seal 104, a lateral seal 106, and a volume of viscous medium 108 located within a cavity that is located between an exterior surface of the core and an interior surface of the medial seal 104. The viscous medium may be, for example, a purely viscous medium, a viscoelastic medium, or a gelled viscous medium. Briefly, when the hearing device 100 is inserted into the ear canal, the viscous medium will occupy the cavity as well as some of the open space between the hearing assistance device and the ear canal. The viscous medium promotes sound attenuation and humidity transport without substantially increasing (i.e., without increasing by more than 50%) the seal pressure on the ear canal wall. In some implementations, the addition of the viscous medium 108 increases the acoustic attenuation of the seal 104 by 3 dB or more. Put another way, in some implementations, the acoustic attenuation caused by the combined seal 104 and viscous medium 108 is at least 3 dB greater than the acoustic attenuation caused by an otherwise identical seal 104 without the viscous medium 108. The core 102, seals 104 and 106, and viscous medium 108 of the exemplary hearing device 100 are each discussed in greater detail below.

Figure 4:
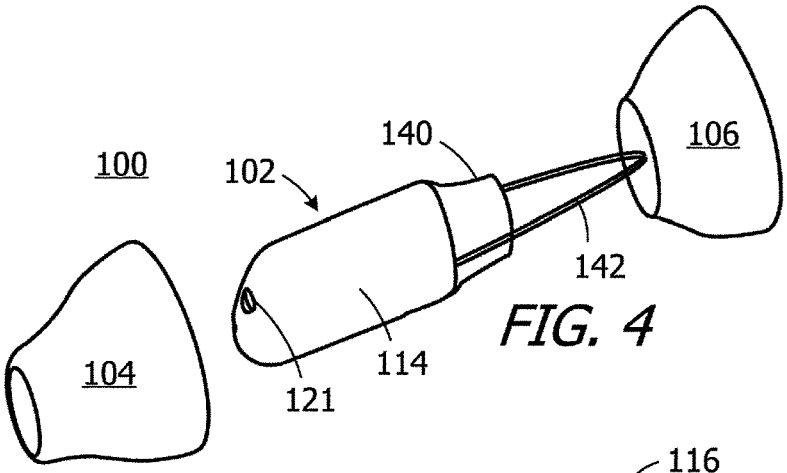
FIG. 4 is an exploded perspective view of the hearing device illustrated in FIGS. 2 and 3.
Figure 5:
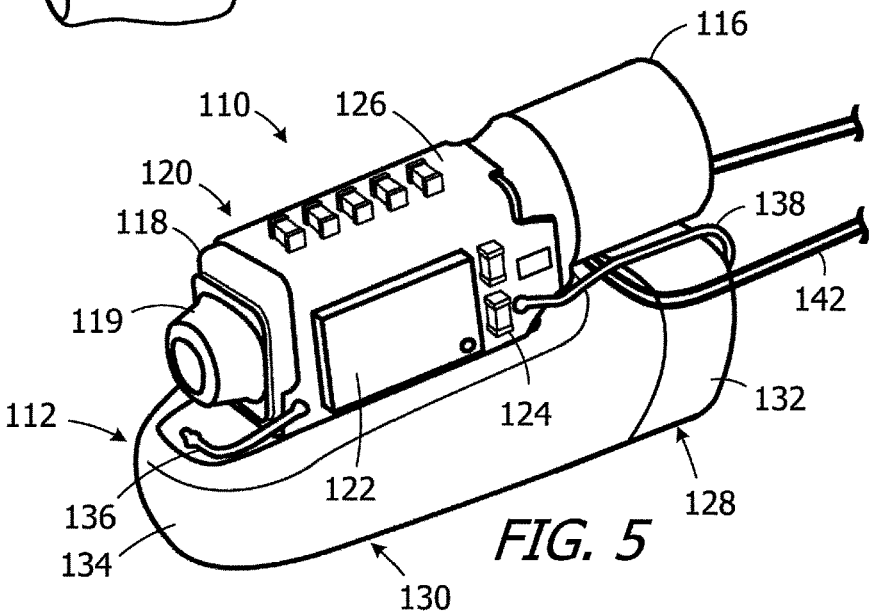
FIG. 5 is a perspective view of a portion of the hearing device illustrated in FIGS. 2 and 3.

Referring first to FIGS. 4 and 5, and although the present inventions are not limited to any particular core, the exemplary core 102 includes an acoustic assembly 110 and a battery 112 (e.g., metal-air battery) located within a housing 114. The acoustic assembly 110 has a microphone 116, a receiver 118 and a flexible circuit 120. The receiver 118 has a sound port 119 that is associated with an aperture 121 on the housing 114. The exemplary flexible circuit 120 includes an integrated circuit or amplifier 122 and other discreet components 124 on a flexible substrate 126. The exemplary battery 112 has a cathode assembly 128 and an anode assembly 130. The exemplary cathode assembly 128 includes a battery can cathode portion 132 and an air cathode (not shown), and the exemplary anode assembly 130 includes a battery can anode portion 134 and anode material (not shown). The cathode assembly 128 and anode assembly 130 may initially be separate, individually formed structural elements that are joined to one another during the manufacturing process. The exemplary battery 112 is electrically connected to the flexible circuit 120 by way of anode and cathode wires 136 and 138. The battery may, in other implementations, be connected to a similar flexible circuit via tabs of the flexible circuit that attach to the battery, and in still other implementations, the anode and cathode wires may be omitted and replaced by anode and cathode contacts on the cathode assembly. A contamination guard 140 with a screen (not shown) abuts the microphone. A handle 142 may also be provided. It should be noted that in other implementations, the housing 114 may be omitted and the acoustic assembly 110, or the acoustic assembly 110 and the battery 112, or the acoustic assembly alone, may be encased by an encapsulant. Additional details concerning the present hearing assistance device cores may be found in U.S. Pat. No. 8,761,423, which is incorporated herein by reference.

Figure 6:
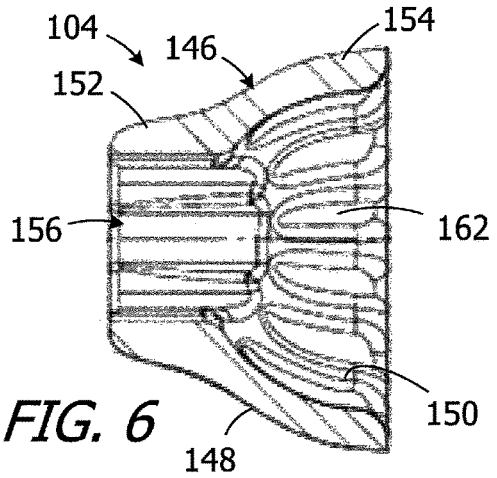
FIG. 6 is a section view of an exemplary seal.
Figure 7:
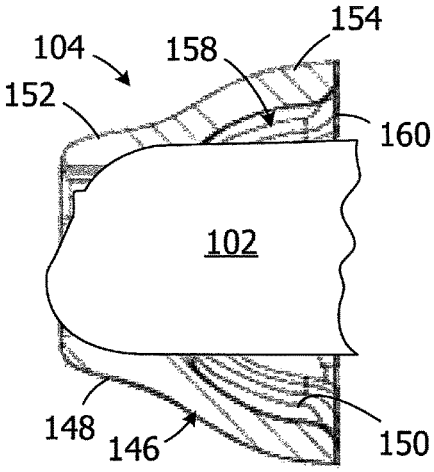
FIG. 7 is a partial section view of an exemplary hearing device core and seal.

Turning to FIGS. 6 and 7, and as noted above, the exemplary seals 104 and 106 support the core 102 within the ear canal bony portion and are configured to substantially conform to the shape of walls of the ear canal, maintain an acoustical seal between a seal surface and the ear canal, and retain the hearing device 100 securely within the ear canal. The medial and lateral seals 104 and 106 are substantially similar, but for minor variations in shape, and the seals are described with reference to medial seal 104 in the interest of brevity. Additional information concerning the specifics of exemplary seal apparatus may be found in U.S. Pat. No. 7,580,537, which is incorporated herein by reference. The medial seal 104 includes a shell wall 146 with an outwardly facing exterior surface 148, an inwardly facing interior surface 150, a base portion 152 and an outwardly bowed portion 154. The base portion 152 includes an opening 156 that is sized and shaped for mounting on the hearing device core 102. The opening 156 may be centrally placed or offset with respect to the shell wall 146, and may be oval, substantially circular or square. The outwardly bowed portion 154 is sized and shaped such that it will be spaced apart from the outer surface of the hearing device core 102. A cavity 158, which has an opening 160 located at the end of the outwardly bowed portion 154, is defined between the exterior surface of the hearing device core 102 and the shell wall interior surface 150. In the illustrated embodiment, the interior surface 150 includes a plurality of scallops 162 that may be used to impart the desired level of stiffness and conformability to the shell wall 146. The seals 104 and 106 may be attached to the core 102 with adhesive.

With respect to materials, the seals 104 and 106 may be formed from compliant material configured to conform to the shape of the ear canal. Suitable materials include elastomeric foams having compliance properties (and dimensions) configured to conform to the shape of the intended portion of the ear canal (e.g., the bony portion) and exert a spring force on the ear canal so as to hold the hearing assistance device 100 in place in the ear canal. Exemplary foams, both open cell and closed cell, include but are not limited to foams formed from polyurethanes, silicones, polyethylenes, fluoropolymers and copolymers thereof. Hydrophilic polyurethane foam is one specific example. In at least some embodiments, all or a portion of the seals can comprise a hydrophobic material including a hydrophobic layer or coating that is also permeable to water vapor transmission. Examples of such materials include, but are not limited to, silicones and fluoropolymers such as expanded polytetrafluoroethylene (PTFE).

Turning to the viscous medium 108, the viscous medium employed will preferably enhance sound attenuation without significantly increasing the stiffness of the associated seal (e.g., seal 104). Exemplary viscous media include, but are not limited to, purely viscous media such as glycerol, petroleum jelly and wax, viscoelastic media such as a rubber, and gelled viscous media (or "gel"). The properties of the gels and other viscous media, which are preferably hygroscopic, provide sufficient moisture transport to promote ear health.

The viscous medium 108 in the illustrated embodiment is a gel. Various examples of gelled viscous media, and the benefits associated therewith, are provided below. The gels may have relatively weak cross-linking between the polymer chains. This results in a structural coherence that is sufficient to prevent the gel from flowing out of the cavity 158, regardless of the orientation of the hearing assistance device, or diffusing into the seal foam during storage at room temperature or usage at body temperature, and also results in a modulus that is low enough to preclude substantial reductions in the compliance of the seal that would increase pressure on the ear canal wall. During manufacture, the hearing assistance device 100 may be oriented such that the medial end faces downwardly and the gel may be injected into the cavity 158 in a liquid state with a syringe or other suitable dispenser. The liquid will be allowed to cure and form the gel 108 that occupies most (or all) of the cavity 158 and is mechanically interlocked with the foam of the seal 104. Because the cavity 158 has an opening 160, and because the gel (or other viscous medium in other embodiments) is not located with a bag, balloon, bladder or other enclosed structure, the gel is free to flow out of the cavity when the seal 104 is compressed. The same manufacturing technique may be employed in conjunction with purely viscous and viscoelastic media.

Figure 8:
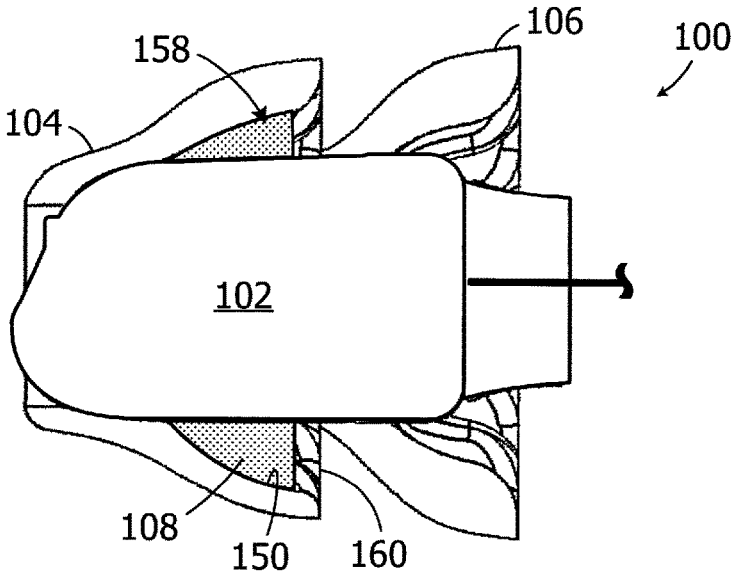
FIG. 8 is a partial section view of the hearing device illustrated in FIGS. 2 and 3.
Figure 9:
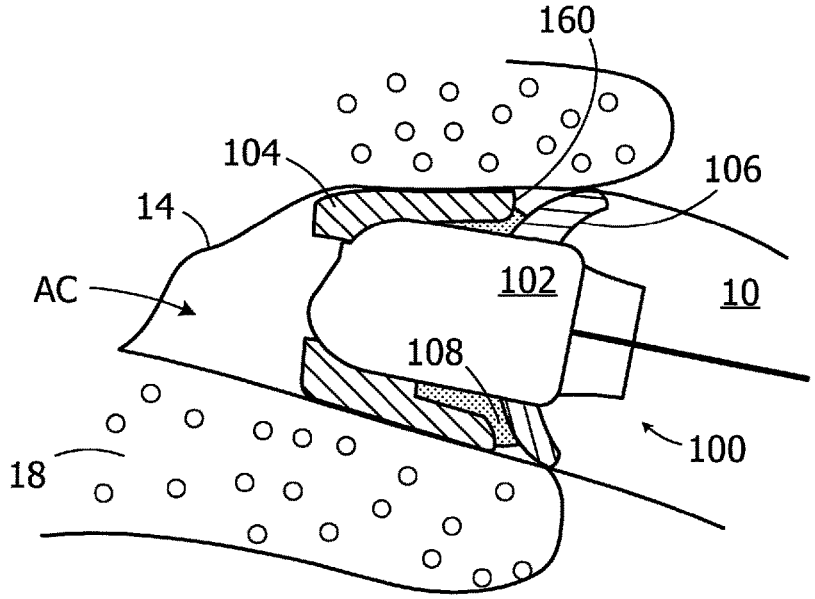
FIG. 9 is a partial section view showing the hearing device illustrated in FIGS. 2 and 3 within the ear canal.

When the hearing assistance device 100 is inserted into the ear canal 10, it will transition from the uncompressed state (FIG. 8) to the compressed state (FIG. 9) where the medial seal 104 is compressed. As a result, a portion of the gel 108 will flow through the opening 160 and into the previously open space defined by the opening 106, outer surface 148 of the lateral seal 106 and the surface of the ear canal wall. The gel 108 (or other viscous media), both that remaining within the cavity 158 and that now outside the cavity 158, will promote sound attenuation and vapor transport without increasing pressure on the ear canal wall.

As noted above, exemplary viscous media include purely viscous media, viscoelastic media, and gels. A purely viscous medium will flow and redistribute as the seal conforms to the canal, thereby occupying space and enhancing overall sound attenuation. The purely viscous medium with not add to the restoring force of the seal 104 and the only pressure against the ear canal walls will only be that provided by the elastic spring force of the compressed seal. The present inventors have determined although that purely viscous media may not flow evenly through the opening 160 and out of the cavity 158 when the seal 104 is pressed into the ear canal and compressed, a purely viscous medium may be useful in some implementations because it does not add to the restoring force of the seal and the pressure exerted onto the ear canal wall. A purely viscous medium may also flow out of the cavity 158 (depending on the orientation of the hearing assistance device) or diffuse into the foam that forms the seal during storage. A viscoelastic medium, on the other hand, will provide a restoring force as it is deflected, which will add to the restoring force of the seals as well as providing sound attenuation. Care must be taken to insure that the total restoring force is less than the venous capillary return pressure of the epithelial tissue layer. Nevertheless, it should be emphasized that, like the purely viscous media, viscoelastic media may be employed as desired or required by particular implementations.

With respect to gels, one exemplary gel is clay/glycerine gel. Clays such as, for example, bentonite, smectite, montmorillonite, hectorite, and synthetic silicate, can swell significantly in aqueous solution or organic polar liquids due to intercalation of liquids into the silicate layers, thereby thickening the solutions into a non-flowable gel. For example, a glycerine gel made with 2.25% clay will remain a non-flowable gel at temperatures up to 100° C. The deflection force associated with the seal 104 and gel 108 will only be about 5-6% greater than that associated with an otherwise identical seal 104 alone. The gel may be produced by the following process: (1) disperse the clay into water to form a water/clay gel, (2) add glycerine to the water/clay gel to form a glycerine/water/clay mixture, and (3) evaporate the water to produce the glycerine/clay gel. The glycerine/clay gel can be placed into a syringe (in liquid form) and dispensed in the manner described above.

Another exemplary gel is Carbopol®/glycerine gel. Carbopol® (polyacrylic acid) leads to a water based hydrogel with trometamol (tris) and propylene glycol. Its viscosity is pH dependent, and the viscosity decreases when pH decreases. Directly mixing Carbopol® into glycerine, followed by neutralization, significantly increases the viscosity of the glycerine. While the viscosity without Carbopol® is about 1150 cp, the viscosity increases to about 26500 cp with 0.4% Carbopol®. Higher amounts of Carbopol® can be dispersed into glycerine for higher viscosities. The gel may be produced by the following process: (1) mix Carbopol® in water, (2) add glycerine, (3) neutralize, and (4) remove the water to produce the Carbopol®/glycerine gel. The Carbopol®/glycerine gel can be placed into a syringe (in liquid form) and dispensed in the manner described above.

Still another exemplary gel is agar-glycerine gel with an agar concentration of about 1.6% to 1.7%. Here, the temperature of the mixture should be about 95° C. to 100° C. (and not yet gelled) when dispensed into the seal in the manner described above. The mixture will begin to gel when it cools to about 40° C.

Yet another exemplary gel is polyvinyl alcohol gel, which is a water based hydrogel that may involve the use of a cross-linking agent such as borane (trihydridoboron).

It should be noted here that the viscous medium 108 may be injected or otherwise dispensed into the cavity 158, which is located between the exterior surface of the hearing device core 102 and the shell wall interior surface 150, at any appropriate time. For example, the viscous medium 108 may be dispensed into the cavity 158 during the hearing device manufacturing process (prior to packaging and shipping), or at the point of sale, or at the time of fitting. In the case of fitting, the viscous medium 108 is provided separately to the hearing healthcare professional (e.g., in a syringe with a dispensing needle) so that the viscous medium 108 can be dispensed into the cavity 158 just moments prior to fitting or inserting the hearing device into the ear canal. A similar process may be employed for those users who are capable of dispensing the viscous medium 108 into the cavity 158 themselves at the time of insertion.

The size and geometry of the ear canal varies from one person to another and, accordingly, so does the size and geometry of the hearing device 100. Variation in the size and geometry of the hearing device 100 may be accomplished by way of variations in the size and geometry of the medial seal 104 and the lateral seal 106. The volume of the cavity 158 between the exterior surface of the hearing device core 102 and the shell wall interior surface 150 will vary from one hearing device to another due to the variations in the size of the medial seal 104, as will the volume of the viscous medium 108 within the cavity 158. The geometry of the ear canal also plays a role in the volume of the cavity 158 when the hearing device is located within the bony region. In those instances where the medium diameter of the hearing device core is about 4 mm, the volume of the viscous medium 108 may range from 5 μl for a medial seal 104 that is appropriate for narrow ear canal (canal medium diameter of 5 mm) to 100 μl for a medial seal 104 that is appropriate for a large ear canal (canal medium diameter of 10 mm).

If the quantity of viscous medium 108 that is dispensed into the cavity 158 is too low, then the acoustic attenuation may not meet the desired level. If, on the other hand, the quantity is too high, the viscous medium 108 may leak out of the cavity 158 in an uncontrolled manner and, possibly, block the microphone contamination guard 140 or cause other undesirable effects. As such, in at least some implementations, the hearing assistance device 100 may be configured to facilitate receipt of the correct amount of viscous medium 108. For example, a mark (not shown) that indicates when maximum volume has been dispensed into the cavity 158 may be located on the interior surface 150 of the medial seal 104. The mark can be added the seal after it is formed, or can be an integrated structure (e.g., a groove or protrusion) that is formed during manufacture of the seal. The mark can extend around the entire circumference of seal inner surface 150 (at the location that corresponds to the desired volume) or can be located at one or more discrete locations on the inner surface. Such a mark is useful, whether the viscous material is dispensed during manufacturing, or by the audiologist, or by the user, because exact dosing of a viscous medium can be challenging.

Certain aspects of the inner surface 150 of the medial seal 104 and/or the outer surface of the core 102 may be initially manufactured, or modified prior to the addition of the viscous medium 108, so as to improve the interaction with the viscous medium. For example, the inner surface 150 of the medial seal 104 and/or the outer surface of the core 102 may be manufactured or modified so as to adhere to a particular viscous medium 108. Such surface aspects include, but are not limited to, roughness, porosity, hydrophobicity and hydrophilicity, as well as any and all combinations thereof.

Although the inventions disclosed herein have been described in terms of the preferred embodiments above, numerous modifications and/or additions to the above-described preferred embodiments would be readily apparent to one skilled in the art. By way of example, but not limitation, the inventions include any combination of the elements from the various species and embodiments disclosed in the specification that are not already described. It is intended that the scope of the present inventions extend to all such modifications and/or additions and that the scope of the present inventions is limited solely by the claims set forth below.

We claim:

1. A hearing device, comprising:

a hearing device core defining an exterior surface, a lateral and a medial end, and including a battery, a microphone and a receiver;

a seal, movable between an uncompressed state that defines a first cavity volume and a compressed state that defines a second cavity volume that is less than the first cavity volume and including a shell wall and defining an outwardly facing exterior surface, an inwardly facing interior surface, a first end and a second end, mounted on the hearing device core with the shell wall first end secured to the hearing device core, the shell wall second end located in spaced relation to the hearing device core and located between the lateral and medial ends of the hearing device core, and a cavity that has an opening located at the shell wall second end defined between the hearing device core exterior surface and the shell wall interior surface; and a volume of viscous medium, which is less than the first cavity volume, located within the cavity between and in contact with the hearing device core exterior surface and the shell wall interior surface.

2. The hearing device of claim 1, wherein the volume of viscous medium within the cavity between the hearing device core exterior surface and the shell wall interior surface is the only viscous medium associated with the hearing device.

3. The hearing device of claim 1, wherein movement of the seal from the uncompressed state to the compressed state forces a portion of the volume of viscous medium through the cavity opening.

4. The hearing device of claim 3, wherein the seal comprises a medial seal that is oriented such that the first end defines the medial end and the second end defines the lateral end;

the hearing device further comprises a lateral seal, including an outwardly facing exterior surface, mounted on the hearing device core such that there is a space that extends from the cavity opening to the lateral seal exterior surface; and the portion of the volume of viscous medium that is forced through the cavity opening is forced into the space that extends from the cavity opening to the lateral seal exterior surface.

5. A hearing device, comprising:

a hearing device core defining an exterior surface and including a battery, a microphone and a receiver;

a seal, including a shell wall and defining an outwardly facing exterior surface, an inwardly facing interior surface, a first end and a second end, mounted on the hearing device core with the shell wall first end secured to the hearing device core, the shell wall second end located in spaced relation to the hearing device core, and a cavity that has an opening located at the shell wall second end defined between the hearing device core exterior surface and the shell wall interior surface, the shell wall is formed being at least in part from a resilient material having sound attenuating properties and water vapor transport properties, defining a longitudinal axis and a perimeter that extends around the longitudinal axis, and being configured to distribute compressive forces applied to the shell wall perimeter such that when the shell is positioned in an ear canal, the shell wall dynamically conforms to changes in the shape of the ear canal and exerts a spring pressure on the ear canal walls that is between about 2 mmHg and about 12 mmHg; and a volume of viscous medium, located within the cavity between the hearing device core exterior surface and the shell wall interior surface, that increases the sound attenuation and water vapor transport properties of the hearing device to levels above that provided by the shell wall without increasing the pressure exerted on the ear canal walls by the shell wall.

6. The hearing device of claim 1, wherein the hearing device core defines a longitudinal axis and the hearing device core exterior surface defines a perimeter that extends around the longitudinal axis;

the cavity extends around the entire perimeter of the hearing device core exterior surface; and the cavity opening extends around the entire perimeter of the hearing device core exterior surface.

7. The hearing device of claim 1, wherein shell wall interior surface includes a plurality of scallops.

8. The hearing device of claim 1, wherein the shell wall is formed from elastomeric foam.

9. The hearing device of claim 1, wherein the seal and viscous medium together cause acoustic attenuation that is at least 3 dB greater than the acoustic attenuation caused by the seal alone.

10. The hearing device of claim 1, wherein the viscous medium comprise a gel.

11. A hearing device, comprising:

a hearing device core defining an exterior surface and including a battery, a microphone and a receiver;

a seal, including a shell wall and defining an outwardly facing exterior surface, an inwardly facing interior surface, a first end and a second end, mounted on the hearing device core with the shell wall first end secured to the hearing device core, the shell wall second end located in spaced relation to the hearing device core, and a cavity that has an opening located at the shell wall second end defined between the hearing device core exterior surface and the shell wall interior surface; and a volume of gel, selected from the group consisting of clay/glycerin gel, carbopol/glycerin gel, agar/glycerin gel and polyvinyl alcohol gel, located within the cavity between the hearing device core exterior surface and the shell wall interior surface.

12. The hearing device of claim 10, wherein the gel is selected from the group consisting of viscous gel and viscoelastic gel.

* * * * *